US006520325B1

(12) United States Patent
Simpson

(10) Patent No.: US 6,520,325 B1
(45) Date of Patent: Feb. 18, 2003

(54) ENDLESS BELT MERCANTILE STORAGE AND DISPLAY SYSTEM, APPARATUS AND METHOD

(76) Inventor: Ellsworth J. Simpson, 12 Montgomery Ter., Fonda, NY (US) 12068

( * ) Notice: Subject to any disclaimer, the term of this patent is extended or adjusted under 35 U.S.C. 154(b) by 59 days.

(21) Appl. No.: 09/721,595

(22) Filed: Nov. 22, 2000

(51) Int. Cl.[7] ..... B65D 85/02
(52) U.S. Cl. ..... 206/303; 206/490
(58) Field of Search ..... 206/303, 408, 206/561, 564, 490

(56) References Cited

U.S. PATENT DOCUMENTS

| | | | | |
|---|---|---|---|---|
| 2,271,943 A | | 2/1942 | Klein et al. | |
| 2,961,141 A | * | 11/1960 | Lukes | 206/303 |
| 3,216,565 A | * | 11/1965 | Davis et al. | 206/303 |
| 3,942,637 A | | 3/1976 | Glennie | |
| 4,083,453 A | * | 4/1978 | Berger et al. | 206/564 |
| 4,150,745 A | * | 4/1979 | Williams et al. | 206/303 |
| 4,162,009 A | | 7/1979 | Schouten | |
| 4,678,084 A | | 7/1987 | Maker et al. | |
| 4,802,577 A | | 2/1989 | O'Leary | |
| 4,890,730 A | | 1/1990 | Kovac | |
| 4,978,004 A | * | 12/1990 | Silverstein et al. | 206/224 |
| 5,344,014 A | | 9/1994 | Toral et al. | |

FOREIGN PATENT DOCUMENTS

| | | |
|---|---|---|
| GB | 178268 | 4/1922 |

* cited by examiner

*Primary Examiner*—David T. Fidei
(74) *Attorney, Agent, or Firm*—Jay R. Yablon

(57) ABSTRACT

An endless drive belt storage and display module enables a plurality of endless drive belts of different sizes to be placed circumferentially, one inside the other, in a way that makes optimal use of available space, causes minimal belt bending, enables easy removal and replacement of any given belt, maintains organization among the belts placed therein, and protects the belts from exposure to elements such as dust and sunlight.

26 Claims, 7 Drawing Sheets

ENDLESS BELT MERCANTILE STORAGE AND DISPLAY SYSTEM, APPARATUS AND METHOD

FIELD OF THE INVENTION

This disclosure relates to the general field of mercantile storage and display, and in particular, to the storage and display of industrial endless belts such as so-called "V-belts."

BACKGROUND OF THE INVENTION

Industrial machines and devices such as, but not limited to, automobiles, lawnmowers, washing machines, drill presses, tillers, snow blowers, compressors, pumps, saws, conveyor systems, crushers, tree debarkers, combines, hay bines, unloaders, sprayers, etc., make widespread use of endless drive belts, such as so-called V-belts, to transmit various driving forces from one drive element to another. These endless industrial drive belts are manufactured in a vast variety of sizes, e.g., diameters, widths, and depths, depending on their intended use, such that a merchant who carries these belts often has a great deal of difficulty storing and displaying them in an organized and compact fashion.

Additionally, these belts 1 are often stored in a manner that causes them to be bent into an overly-tight curvature radius at various positions around their circumference, such as, but not limited to, when they are commonly packaged as shown in FIG. 1. These types of substantially asymmetric belt storage methods can cause belt to stretch unnaturally in certain regions (such as at the opposite end regions of FIG. 1) and become deformed and misshapen, which can damage the belt and limit its useful lifetime. While such belts are manufactured to be bent when inn use, the storing of a belt for a long period of time with a severe bend in one portion of the belt can be harmful to the belt by unduly stressing the cords at that bent belt portion and causing premature failure of that belt. The natural configuration of such belts is circular or nearly circular (i.e., ovular), with a convex curvature around the entire outer circumference of these belts, and its is desirable to store these belts in a manner that does not deform these belts too much from such a natural configuration.

The prior art reveals a limited number of efforts to provide for the storage of endless drive belts, all of which are unsatisfactory in various way. U.S. Pat. No. 4,150,745, for example, illustrates a belt packaging tray. Although this tray appears to provide a compact means for shipping a plurality of endless drive belts, these belts are tightly and unnaturally wound in a way that can deform their natural shape. In particular, this tray causes some regions of the outer circumferences of these belts to be unnaturally bent with a concave curvature, such as in the region of FIG. 1 surrounding reference numeral 14*c*. This concave bending of a belt opposite to the natural bend with which it is manufactured and used is particularly harmful to belt life. In addition, the packaging of U.S. Pat. No. 4,150,745 causes other outer circumference belt regions to be bent convexly, but too tightly relative to the natural radius of curvature, such as in the upper left and upper right regions of FIG. 1. This too is harmful to belt life. Also, it does not appear to be possible to easily remove and replace any one belt from this tray without disrupting all of the other belts in the tray.

U.S. Pat. No. 3,942,637 similarly discloses an endless belt package which introduces unnatural curvatures into the belts, and also, which wastes valuable space that might otherwise be used for compact and efficient belt storage, such as the spaces in FIG. 3 that enclose reference numerals 31, 22, 35, and 27. Here too, it does not appear to be possible to easily remove and replace any one belt from this tray without disrupting all of the other belts in the tray.

A related patent, U.S. Pat. No. 4,162,009, is for packaging endless fabrics, rather than drive belts. However, if the teachings of this patent were applied to the non-analogous art area of drive belts, the unnaturally-tight bending illustrated in this patent, while perhaps suitable for fabrics, could again be damaging if applied to drive belts. Similarly, removal and replacement of any one fabric without disrupting the remaining fabrics appears to be impossible.

Also of background interest is U.S. Pat. No. 4,890,730, insofar as the device disclosed therein appears to be used to hold several different sizes of elastic bands such as rubber bands.

However, none of these references addresses the fundamental concern of compactly storing and displaying a large variety of endless drive belts in a systematic, organized manner, for mercantile use, without introducing unnatural and possibly-deforming bends into these belts.

OBJECTS OF THE INVENTION

It would therefore be desirable to provide a system, apparatus and method that enables drive belts of a wide range of sizes to be easily and compactly stored in an organized manner.

It is further desirable for the same system, apparatus and method that stores these endless drive belts to also be usable to display these belts without having to remove the belts from storage, thereby enabling a drive belt merchant to easily convert between the storage and the display of his or her drive belts.

It is further desirable to enable individual drive belts to be removed from storage or display, and later replaced back into storage or display, easily, quickly, and without disrupting the remaining belts which are not removed.

It is further desirable to ensure that drive belts are stored and displayed in a manner that does not cause unnatural bending, either by bending the outer circumference of the belts concavely, or by bending the outer circumference of the belts convexly with a curvature radius that exceeds their natural radius of curvature by more than 2 to 1, or 3 to 1, or 4 to 1, or 5 to 1, or, at the outerlimit, 6 to 1.

It is further desirable for drive belts to be stored in a way that enables identifying labels on the sides of these belts to be easily viewed while the belts are in storage.

It is further desirable to ensure that drive belts are stored in an environment where they are protected from exposure to elements such as dust and sunlight.

SUMMARY OF THE INVENTION

An endless drive belt storage and display module enables a plurality of endless drive belts of different sizes to be placed circumferentially, one inside the other, in a way that makes optimal use of available space, causes minimal belt bending, enables easy removal and replacement of any given belt, maintains organization among the belts placed therein, and protects the belts from exposure to elements such as dust and sunlight.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE INVENTION

As noted above, endless drive belts are manufactured in many different sizes. It is helpful, therefore, to begin by surveying the range of size and related characteristics common to endless drive belts, since this provides a basis for understanding the mercantile storage and display requirements for these belts, and for developing a suitable-system, apparatus and method for the maintenance—defined herein as the storage and/or display—of such endless drive belts.

Figures 1, 2, 3, 4, 5:
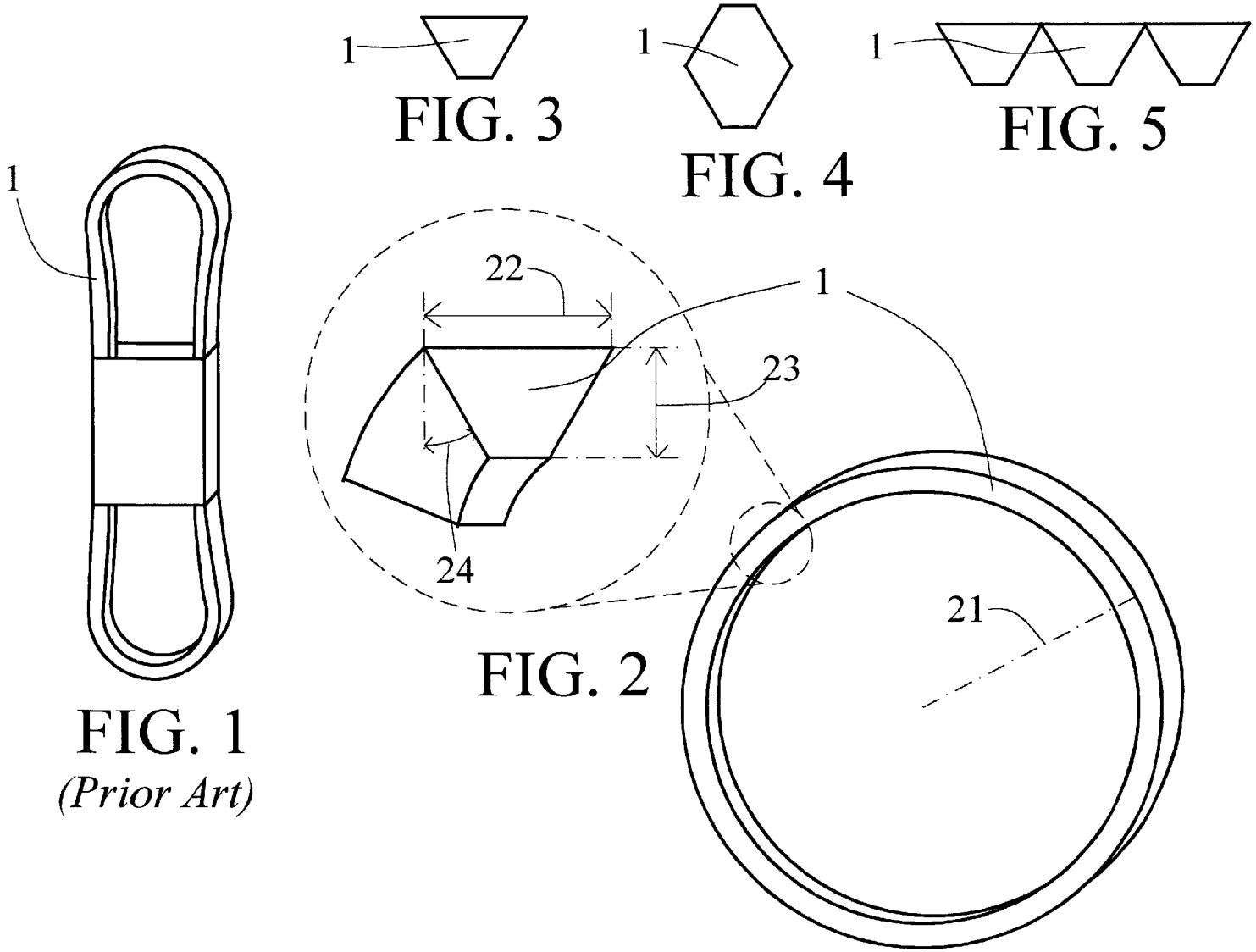
FIG. 1 (Prior Art)
FIG. 1 is a perspective view illustrating the manner in which endless drive belts are commonly stored according to the prior art.
FIG. 2 is a perspective and exploded cross-sectional perspective view of a typical, representative endless drive belt such as is stored and displayed according to several invention embodiments disclosed herein.
FIGS. 3, 4 and 5 illustrate cross-sectional views of endless drive belt shapes that are commonly used in the art.

In its natural shape, an endless drive belt 1 is fully circular, as illustrated toward the right hand side of FIG. 2. The radius R, 21, is by common practice defined as the distance from the center of endless drive belt 1 to the outer (not inner) circumferential surface of endless drive belt 1, as illustrated. The circumference C of the outer circumferential surface of endless drive belt 1 is related in the expected manner to the radius by:

$$C=2_{\pi}\cdot R \tag{1}$$

The size of an endless drive belt 1 is characterized by common practice in the art according to the outer circumference C of endless drive belt 1, and also, according to the outer circumference width W, 22, of endless drive belt 1, as shown in the exploded sectional view of FIG. 2. Focusing for a moment on width 22, it is common practice to refer to belts broadly, for example, as 2L, 3L, 4L, and 5L, wherein the numbered prefix represents the width 22 of endless drive belt 1 in eighths of an inch. Thus, a 5L belt, for example, has a width 22 of ⅝ inch.

The other important parameter is the thickness T, 23 of endless drive belt 1. While there is not an exact relationship between width W, 22 and thickness T, 23 in all cases, there is a fair correlation insofar as wider belts such as 4L and 5L tend to lo also be proportionately thicker than narrower belts such as 2L and 3L. This correlation is helpful in designing a suitable storage and display system, apparatus and method for such endless drive belts 1.

Finally, it is to be noted that the "V" in the belt is generally manufactured at a given V-angle 24. A V-angle 24 of 30 degrees, which is quite common in the art, is illustrated. Another common V-angle 24 is 40 degrees, not illustrated here. The storage of belts of any V-angle 24, including but not limited to the 30 and 40 degree V-angles 24 most widely practiced in the at, is fully considered within the scope of this disclosure and its associated claims.

It is also helpful to observe that while the "V" cross-sectional profile shown for endless drive belt 1 in FIG. 2 and also replicated in FIG. 3 is common in the art, that other profiles are also used in the art. These include, but are not limited to, the double-belt cross section shown in FIG. 4 (which uses two V's relatively inverted, and back to back along width W) and the multi-section cross section shown in FIG. 5 (which uses two or more similarly-oriented V's, side by side, in a "w" or extended "w" profile).

While discussion to follow will utilize 2L, 3L, 4L and 5L width endless drive belts 1 as examples in order to discuss belt storage and display generally, it is to be understood that the disclosure to follow applies equally well to any other width endless drive belts 1 that one might wish to consider, and that the storage and display of endless drive belts 1 other than the 2L, 3L, 4L and 5L width belts discussed here, using the system, device and method disclosed herein, is considered to be within the scope of this disclosure and its associated claims. This includes any other system of non-metric or metric belt size characterization used or which may become used in the art, including the A, B, C, D, E belt classification systems used in many locations outside of North America. Similarly, while this discussion will use ordinary, single-V (FIG. 3) endless drive belts 1 as an example, this in no way limits this disclosure or its associated claims to storing and displaying single-V belts. All other configurations, including but not limited to those of FIGS. 4 and 5, are also considered herein. Similarly, the illustration of a 30 degree V-angle 24 is for example, only, and is not limiting with respect to this disclosure or its associated claims. Finally, while the discussion to follow will utilize certain particular outer circumferences C of these endless drive belts 1 as examples, it is understood that this disclosure and its associated claims also apply to belt circumferences that may not be specifically discussed and illustrated here.

In short, the discussion to follow will use a limited number of non-metric, single-V, 30 degree, 2L- through 5L-width, varying-circumference belts as examples, but this is simply for the purpose of illustrating applicant's invention, and should not be interpreted in any way to limit the sizes and types of endless drive belts 1 to which applicant's disclosure and its associated claims can be applied.

Figure 6:
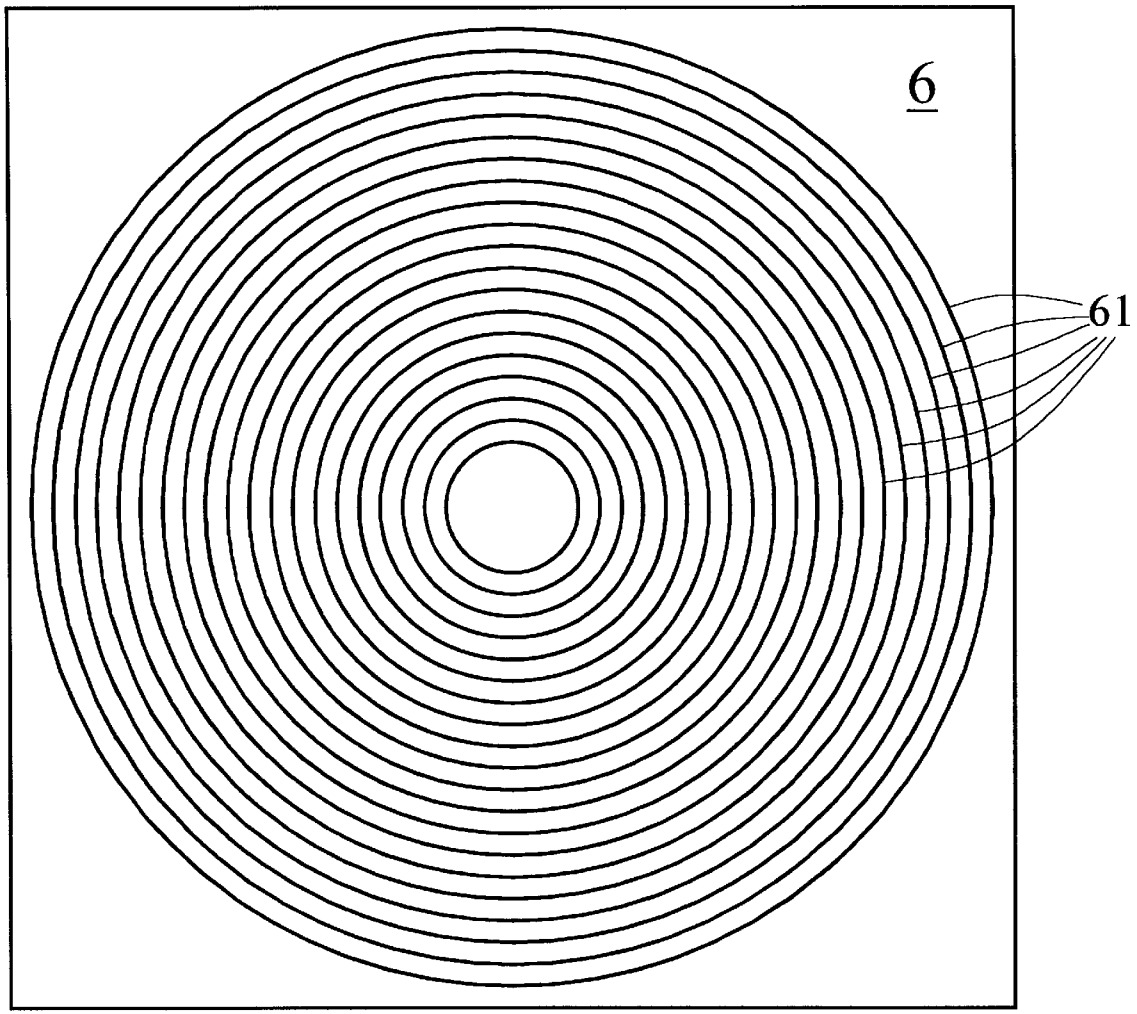
FIG. 6 is a top plan view illustrating an endless drive belt storage and display module, in a first preferred embodiment of the invention.

As now illustrated in FIG. 6, the basic unit of applicant's invention is a drive belt storage and display module 6 comprising a plurality of drive belt guides 61 such as, but not limited to, the illustrated concentric ribs shown in FIG. 6. Drive belt storage and display module 6 in this embodiment is a substantially flat, planar surface upon which drive belts can be rested. The drive belt guides 61 comprise, in this embodiment, a plurality of raised concentric ribs such that each drive belt to be stored or displayed in storage and display module 6 can be rested flat against the planar surface of drive belt storage and display module 6 in between suitable drive belt guides 61.

Figure 7:
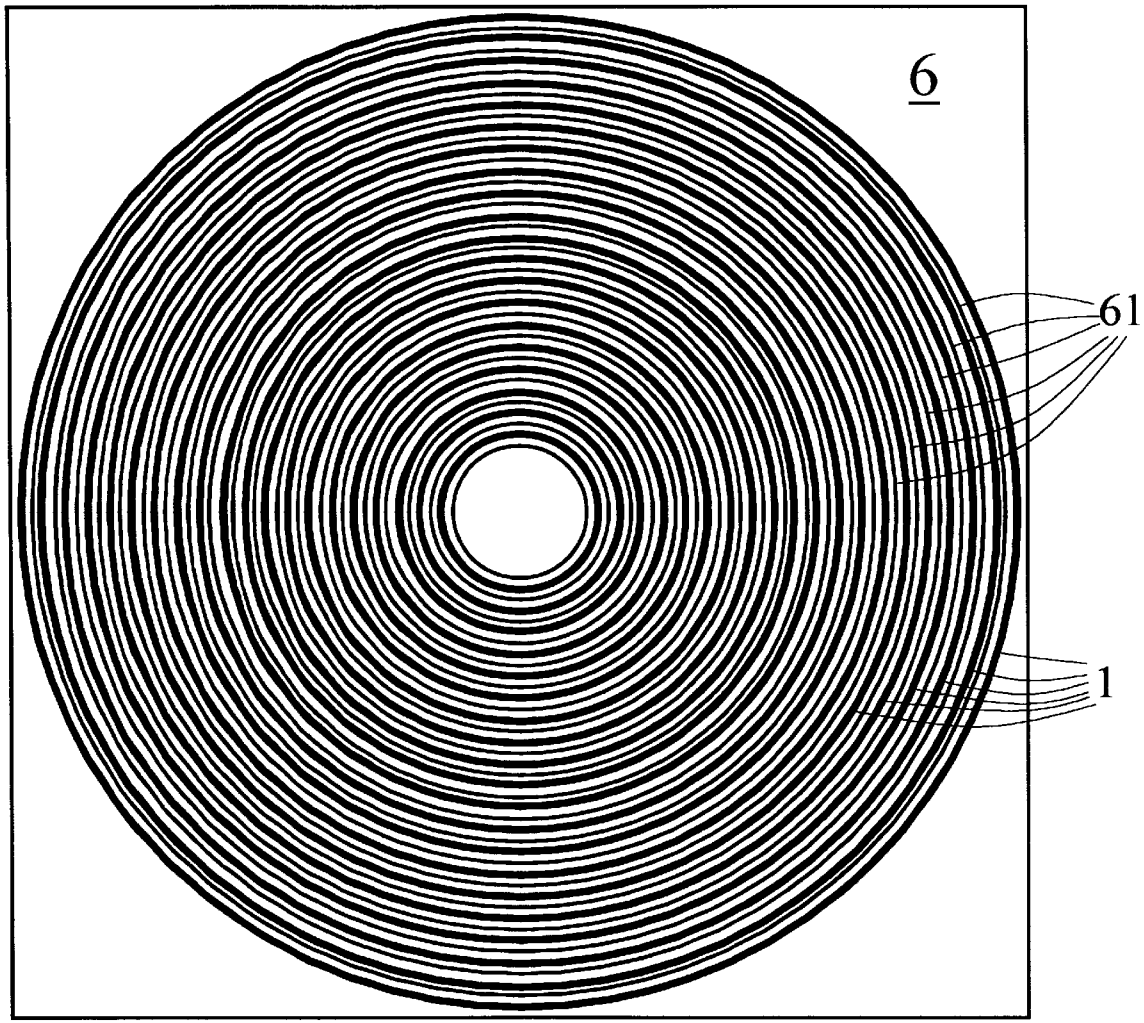
FIG. 7 is a top plan view illustrating the endless drive belt storage and display module of FIG. 6, containing a plurality of endless drive belts stored therein.

As illustrated in FIG. 7, when it desired to store a plurality of differing-circumference drive belts 1 in storage and display module 6, each drive belt 1 is simply placed between two adjacent appropriately-sized drive belt guides 61. There is no danger of a drive belt 1 being bent out of shape either convexly or concavely, because the drive belt guides 61 maintain each belt in a substantially circular configuration, at the belt's natural radius of curvature. Because drive belts 1 are stored circumferentially within one another from large to small circumference, there is very little wasted space, and hence storage and display is very compact. And, as will be discussed further below, the overall storage system, apparatus and method uses a plurality of appropriate drive belt storage and display modules 6 similar to that shown in FIG. 6, such that a wide variety of belt widths can all be stored and displayed in a very compact space, in a very organized system that corresponds closely with the way in which these belts are manufactured, distributed, and characterized. Finally, it is preferred that the drive belt guides 61 be deep enough to maintain several identical belts of any given width and circumference on top of one another, i.e., that identical belts can be stored two, three, four or even more drive belt layers deep. Thus, for example, if it were desired to store three 3L (=⅜ inch wide) belts of a given circumference, then drive belt guides 61 would need to be 3×⅜=1 ⅛ inches deep. This depth, D, is illustrated by reference numeral 80 in FIG. 8.

At this point, we turn to examine more closely the manner in which endless drive belts 1 are typically distributed according to industry practice, to determine more specifically the organizational structures required for drive belt storage and display modules 6 in order to fully store and display a broad range of endless drive belts 1.

As noted above, endless drive belts 1 are typically classified according to their circumference C, and in non-metric systems, are generally manufactured in discrete 1 inch circumference intervals. Thus, for example, the most commonly-used 5L (=⅝ inch thick) belts 1 run from a 26 inch circumference up to a 120 inch circumference, one inch at a time. That is, for 5L belts, C=26, 27, 28, . . . 120 inches. For the most common 4L belts, C=15, 16, 17, . . . 100 inches. For the most common 3L belts, C=11, 12, 13, . . . 80 inches. And for the most common 2L belts, C=11, 12, 13, . . . 46 inches.

Because adjacent-circumference endless drive belts 1 differ from one another by 1 inch, the radii of two adjacent-circumference endless drive belts 1, using equation 1, will differ from one another by:

$$\Delta R=(C+1)/2\pi-C/2\pi=1/2\pi\approx 0.159 \text{ inches} \quad (2)$$

Thus, if the thickness T of two adjacent-circumference endless drive belts 1 is much over about 0.15 inches, it will not be possible to store two adjacent-circumference endless drive belts 1 circumferentially within one another. Instead, it will be necessary to skip over intermediate sizes and use two drive belt storage and display modules 6, one for "even" circumference belts, and one for "odd" circumference belts. Similarly, if the thickness T of two adjacent-circumference endless drive belts 1 is much over about 0.3 inches=2×0.15 inches, then it will be necessary to use three drive belt storage and display modules 6 for every third size. If the thickness T of two adjacent-circumference endless drive belts 1 is much over about 0.45 inches=3×0.15 inches, then four drive belt storage and display modules 6. Five drive belt storage and display modules 6 would be needed for T>about 0.6 inches. And so on.

Applicant, in surveying the commonly-manufactured endless drive belts 1, has observed that the thickness T of 5L belts is always less than 0.6 inches, but can be greater than 0.45 inches. So four drive belt storage and display modules 6 are required to store all circumferences of 5L belts, with adjacently-stored endless drive belts 1 within any one belt storage and display module 6 differing from one another by 4 inches in circumference, and hence by radius R≈0.637 inches. Similarly, the thickness T of 4L belts is always less than 0.45 inches, but can be greater than 0.3 inches. So three drive belt storage and display modules 6 are required to store all circumferences of 4L belts, with adjacently-stored endless drive belts 1 within any one belt storage and display module 6 differing from one another by 3 inches in circumference, and hence by radius R≈0.478 inches. The thickness T of 3L belts is always less than 0.3 inches, but can be greater than 0.15 inches. So two drive belt storage and display modules 6 are required to store all circumferences of 3L belts, with adjacently-stored endless drive belts 1 within any one belt storage and display module 6 differing from one another by 2 inches in circumference, and hence by radius R≈0.318 inches. Finally, in most instances, the thickness T of 2L belts is always less than 0.15 inches, but in some instances a 2L belt can slightly exceed 0.15 inches. Thus, it may be possible in some situations to store all circumferences of 2L belt in a single belt storage and display module 6, but in other instances, two belt storage and display modules 6 storing "even" and "odd" circumferences may be needed.

Thus, a total of 10 or 11=4+3+2+(1 or 2) belt storage and display modules 6 are need to store and display all commonly-available circumferences of 5L, 4L, 3L, and 2L endless drive belts 1. To store and display more than one belt (N belts) of a given size and thickness, the minimum depth D of the drive belt guides 61 must be N×⅝ inches for 5L belts, N×½ inches for 4L belts, N×⅜ inches for 3L belts, and N×¼ inches for 2L belts. Generally, to store and display N yL belts of identical circumferences, depth D must be:

$$D \geq N \times y/8 \quad (3)$$

Figure 8:
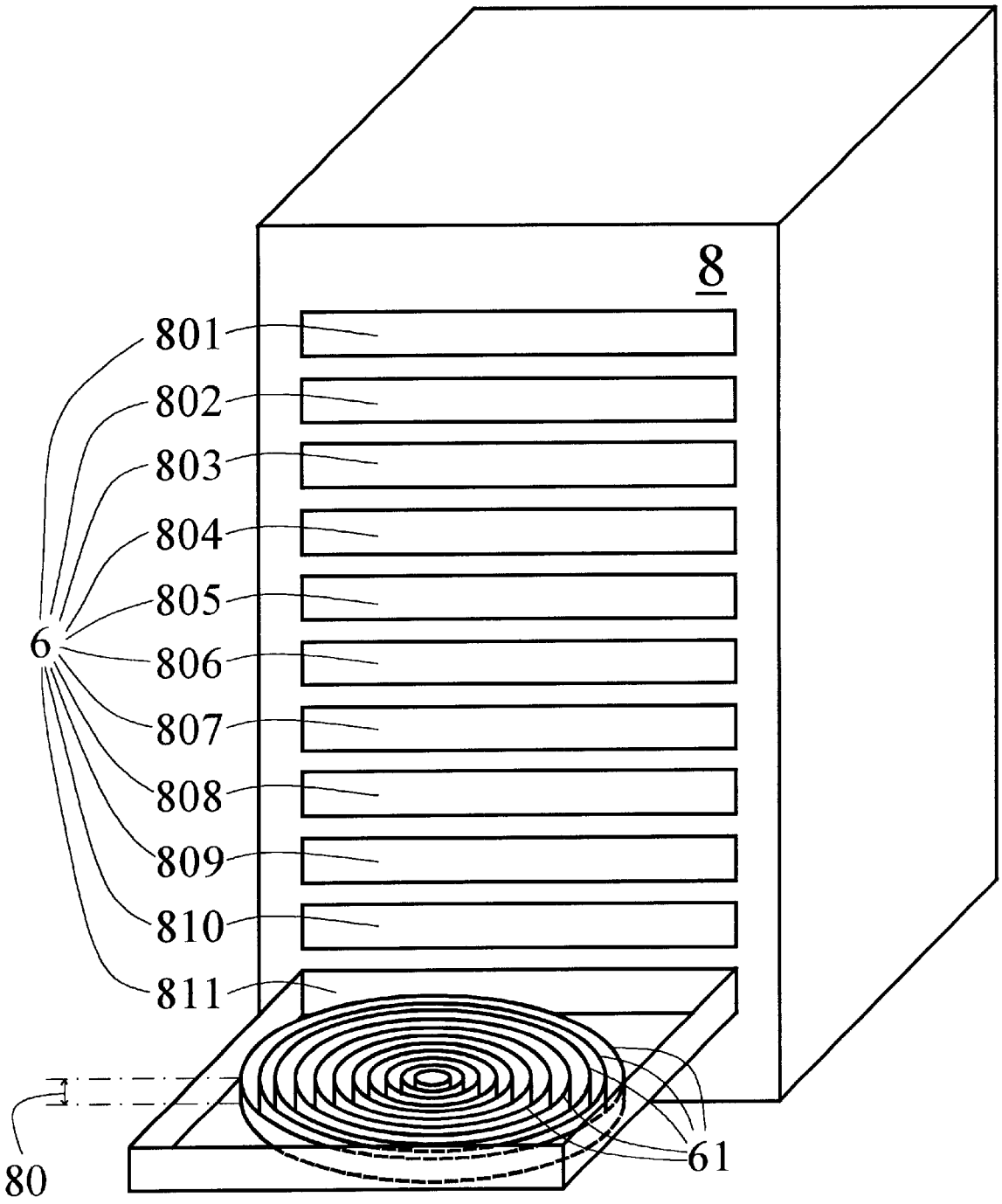
FIG. 8 is a perspective view illustrating a drive belt storage facility comprising a plurality of the endless drive belt storage and display modules of FIGS. 6 and 7.

FIG. 8 therefore illustrates a drive belt storage facility 8 comprising eleven belt storage and display modules 6, capable of storing all circumferences of all of the 2L, 3L, 4L and 5L endless drive belts 1. The bottom belt storage and display module 811 is illustrated as being pulled out from belt storage facility 8 in the same way that a drawer is ordinarily extended from a cabinet, and it is to be understood that the remaining belt storage and display modules 6 are similar to 811, and in particular all have their own sets of drive belt guides 61, but are inside of drive belt storage facility 8 in the same manner that a drawer resides inside of a cabinet. Also illustrated is the depth D (80) of the drive belt guides 61 of module 811. It is to be observed that the placement of these belt storage and display modules 6 relative to one another can of course be varied considerably within the scope of this disclosure and its associated claims, that is, that it doesn't matter which module 6 is on top, what order these modules 6 are in, whether they are lined up vertically, horizontally, or in some other geometric orientation relative to one another, whether the "drawer" is a rectangle or some other shape, etc.

In the preferred embodiment, although not a requirement, each belt storage and display module 6 is fully removable from drive belt storage facility 8. In this manner, when storage display modules 6 reside within drive belt storage facility 8, these are storage devices, protecting their endless drive belts 1 from elements such as dust and sunlight. When storage display modules 6 are removed from drive belt storage facility 8, they can, for example, be hung on a wall or placed on a flat surface as a mercantile display. Importantly, the conversion from storage to display and back to storage is as simple as removing a drawer from a cabinet and later replacing it back into the cabinet, and does not at all disrupt the endless drive belts 1 themselves.

In the example illustrated in FIG. 8, belt storage and display modules 801, 802, 803, and,804 comprise the four 5L storage drawers. Recall that based on thickness T, 23, is it necessary to adjacently store the 5L belts which differ from one another by four inches in circumference. The first belt storage and display module, 801, comprises drive belt guides 61 suitable for placement of 5L belts, as in FIG. 7, with circumferences C=26, 30, 34, . . . 118 inches. The next module, 802, comprises drive belt guides 61 suitable for placement of 5L belts with circumferences C=27, 31, 35, . . . 119 inches. Module 803 comprises drive belt guides 61 suitable for placement of 5L belts with circumferences C=28, 32, 36, . . . 120 inches. Module 804 comprises drive belt guides 61 suitable for placement of 5L belts with circumferences C=29, 33, 37 . . . 117 inches.

Similarly, belt storage and display modules 805, 806, and 807 comprise the three 4L storage and display modules 6, which, recall, are stored in three sets. Thus, module 805 comprises drive belt guides 61 suitable for placement of 4L belts with circumferences C=15, 18, 21, . . . 99 inches. Module 806 comprises drive belt guides 61 suitable for placement of 4L belts with circumferences C=16, 19, 22, . . . 100 inches. And, module 807 comprises drive belt guides 61 suitable for placement of 4L belts with circumferences C=17, 20, 23, . . . 98 inches.

Belt storage and display modules 808 and 809 comprise the two 3L storage and display modules 6, which, recall, are stored in two ("odd" and "even") sets. Thus, module 808 comprises drive belt guides 61 suitable for placement of 3L belts with circumferences C=11, 13, 15, . . . 79 inches, and module 809 comprises drive belt guides 61 suitable for placement of 3L belts with circumferences C=10, 12, 14, . . . 80 inches.

Finally, belt storage and display modules 810, and 811 comprise the two 2L storage and display modules 6. Recall that 2L belts can in some instances be stored in a single drawer, but for this example, are to be stored in two ("odd" and "even") sets. Thus, module 810 comprises drive belt guides 61 suitable for placement of 2L belts with circumferences C=11, 13, 15, 45 inches, and module 811 comprises drive belt guides 61 suitable for placement of 3L belts with circumferences C=12, 14, 16, . . . 46 inches. (Note that this would actually require eighteen drive belt guides 61, but that to avoid overcrowding of the illustration, a lesser number of drive belt guides 61 are in fact illustrated.)

At this point, a number of generalizations can be made regarding the storage of endless drive belts 1 according to the device, system, and method disclosed thus far. While the belts discussed thus far differ from one another by circumferences of 1 inch, we generalize to the situation where the circumferences of adjacently-circumferenced belts differ from one another by a predetermined circumferential length δ, as represented in some system of linear measurement. We also generalize to the situation where it is desired to store a total of N (duplicate, identical) endless drive belts 1 for any given width W (22) and circumference C. And, we generalize to the situation where the belts of this given width W have a maximum thickness T (23), which, as noted earlier, will determined their required storage and display spacing as well as the number of belt storage and display modules 6 required to store and display belts of all available circumferences. Such a set of drive belts of given width W (22), maximum thickness T (23), and circumferential length difference δ will be referred to as a "drive belt set."

First of all, it is easily generalized from eq. (2) that the radial difference ΔR between adjacently-circumferenced belts is:

$$\Delta R=(C+6)/2\pi-C/2\pi=\delta/2\pi \tag{4}$$

Next, it is deduced that the number, M, of belt storage and display modules 6 required to store all circumferences of these maximum thickness T belts is equal to:

$$M=\mathrm{int}(T/\Delta R)+1=\mathrm{int}(2\pi T/\delta)+1, \tag{5}$$

where int(x) denotes the integer part of x.

Consequently, adjacently-stored belts within any given belt storage and display module 6 will differ from one another in circumference by:

$$\Delta C=M\bullet\delta=\delta[\mathrm{int}(2\pi T/\delta)+1]. \tag{6a}$$

and in radius by:

$$M\bullet\Delta R=M\bullet\delta/2\pi \tag{6b}$$

If the minimum belt circumference to be stored for a belt set of the given width W is $C_{min}$ and the maximum belt circumference to be stored for this same belt set of the given width W is $C_{max}$ (for the 5L example earlier given, $C_{min}$=26 inches and $C_{max}$=120 inches), than a first one of these M belt storage and display modules 6 will store belts ranging in size from $C_{smallest}=C_{min}$ to $C_{largest}=C_{min}+\Delta C\cdot x$, by circumferential increments of ΔC, where x is the largest integer that can be chosen such that $C_{largest}\leqq C_{max}$. If M>1, than a second one of these M belt storage and display modules 6 will store belts ranging in size from $C_{smallest}=C_{min}+\delta$ to $C_{largest}=C_{min}+\delta+\Delta C\cdot x$, by circumferential increments of ΔC, where x is the largest integer that can be chosen such that $C_{largest}<C_{max}$. Any additional belt storage and display modules 6, if necessary, will store belts ranging in size from $C_{smallest}=C_{min}+z\bullet\delta$ to $C_{largest}=C_{min}+z\bullet\delta+\Delta C\cdot x$, by ΔC, where x is the largest integer that can be chosen such that $C_{largest}<C_{max}$, and where z=2, 3, . . . M−1.

Thus, for any given one of these M belt storage and display modules 6, if the minimum belt circumference to be stored in that module 6 is $C_{smallest}$ and the maximum belt circumference to be stored in that module 6 is $C_{largest}$, then the total number T of differently-circumferenced belts stored within that belt storage and display module 6 will be given by:

$$T=(C_{smallest}-C_{largest})/M+1. \tag{7}$$

Finally, as noted in eq. (3) above, the storage and display depth D (80) of the associated belt storage and display module 6, and particularly of its associated drive belt guides 61, must be:

$$D\geqq N\times W. \tag{8}$$

We turn at this point to examine several other preferred embodiments for belt storage and display modules 6 and their associated drive belt guides 61.

Recall that in FIG. 6 (see also the perspective view of FIG. 8), the drive belt guides 61 of belt storage and display modules 6 comprised a series of concentric, circular ribs. This configuration for drive belt guides 61 is only one of numerous possible embodiments for drive belt guides 61. The main purpose of drive belt guides 61 is to maintain endless drive belts 1 in place while they are stored or displayed circumferentially within one another. Thus, any embodiment of drive belt guides 61 that is capable of maintaining endless drive belts 1 in their stored and displayed positions within belt storage and display modules 6 is considered to be within the scope of this disclosure and its associated claims.

FIGS. 9–18, however, illustrate some specific alternative jag preferred embodiments for belt storage and display modules 6 and drive belt guides 61, as well as various examples of ways in which the endless drive belts 1 can be stored, simply to provide examples of some of the many possible system, apparatus and method embodiments that can be used to maintain endless drive belts 1 in their stored and displayed positions.

Figure 9:
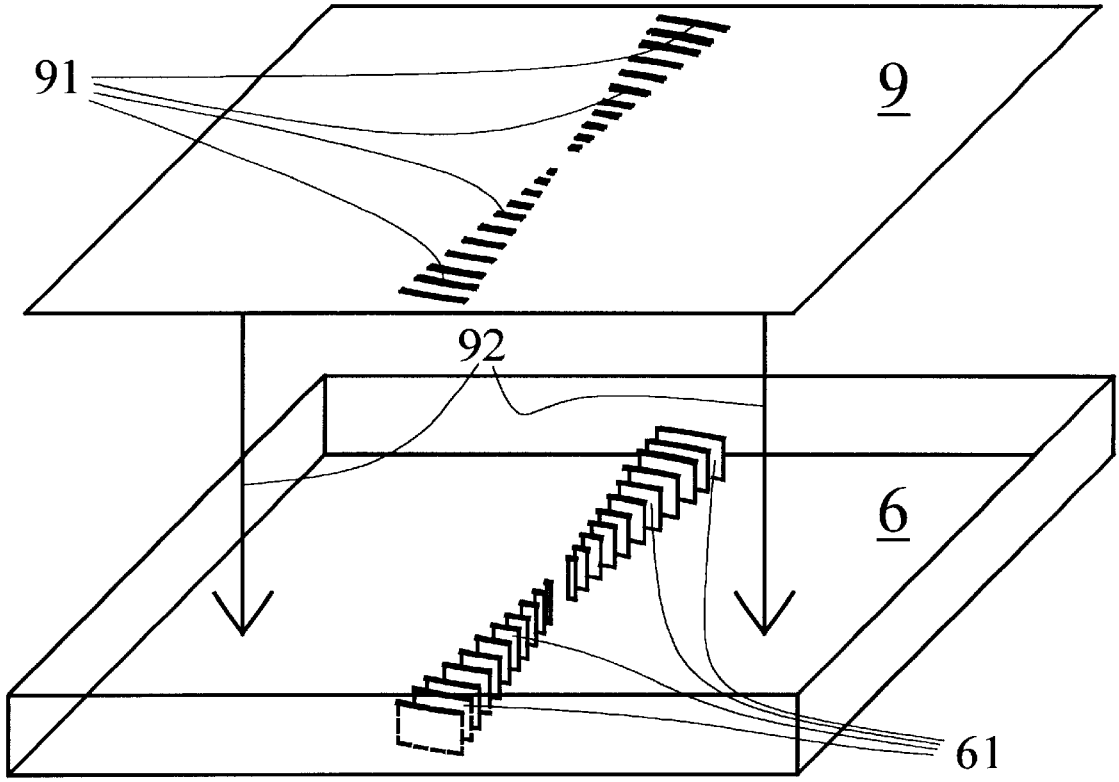
FIG. 9 is a perspective view illustrating an endless drive belt storage and display module, in a second preferred embodiment of the invention, as well as a belt layer divider.

In FIG. 9, drive belt guides 61 comprise two sets of belt guide structures, such as but not limited to the illustrated ribs, across from one another on opposite sides of belt storage and display module 6, as illustrated. It is to be noted for later reference that the line drawn on the top of each drive belt guide 61 is slightly thicker than the remaining lines in the drawing, schematically denoting a belt retention feature as will be discussed further below. Also illustrated is a belt layer divider 9 with a plurality of divider apertures 91 aligning with drive belt guides 61, which will also be discussed below. When belt layer divider 9 is moved toward belt storage and display module 6 as illustrated by the arrows 92, drive belt guides 61 pass through divider apertures 91.

Figure 10:
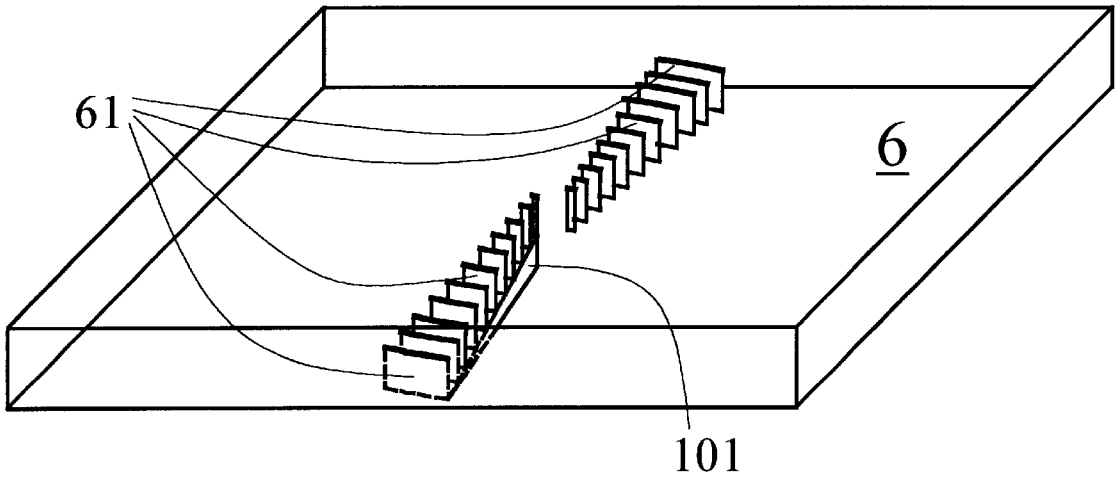
FIG. 10 is a perspective view of the FIG. 9 embodiment, also including a belt label display enhancer.

The belt storage and display module 6 of FIG. 10 is similar to that of FIG. 9, but each drive belt guide 61 in the set toward the bottom of FIG. 10 is elevated from the plane bottom of belt storage and display module 6 with respect to its adjacent drive belt guide 61, using a belt label display enhancer 101 such as, but not limited to, the illustrated belt label display ramp. The purpose of this will also be discussed shortly below.

Figure 11:
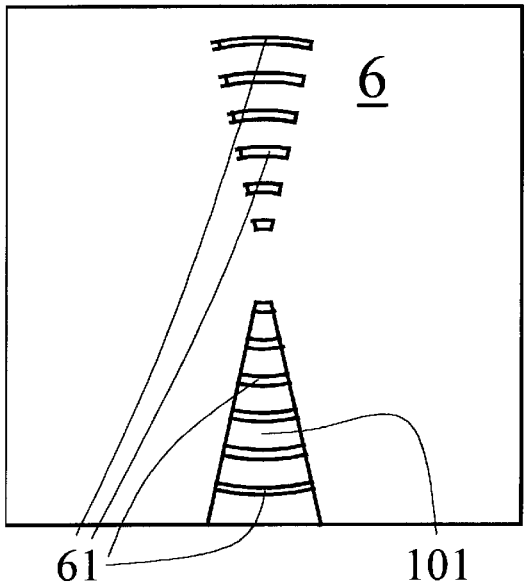
FIG. 11 is a schematic, top, plan view of the embodiment of FIG. 10.
Figure 12:
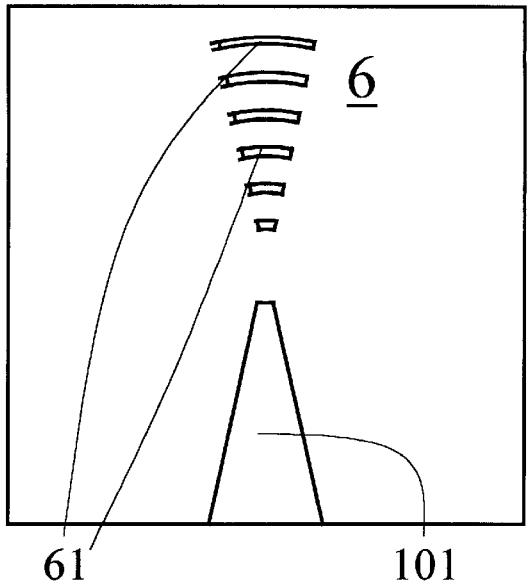
FIGS. 12–14 are schematic, top, plan views of third, fourth, and fifth preferred embodiments of an endless drive belt storage and display module.
Figure 13:
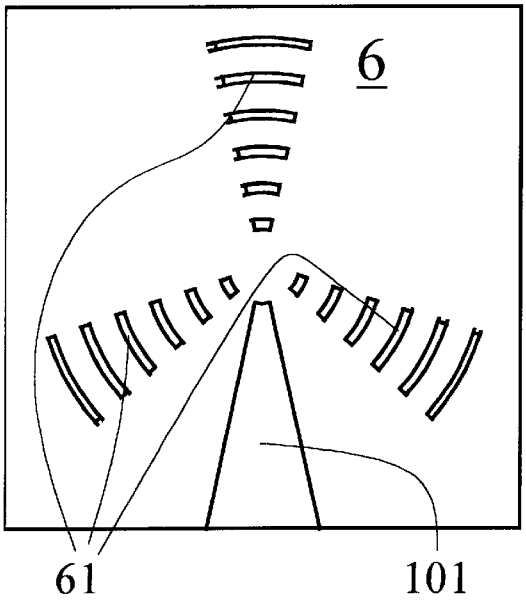
Figure 14:
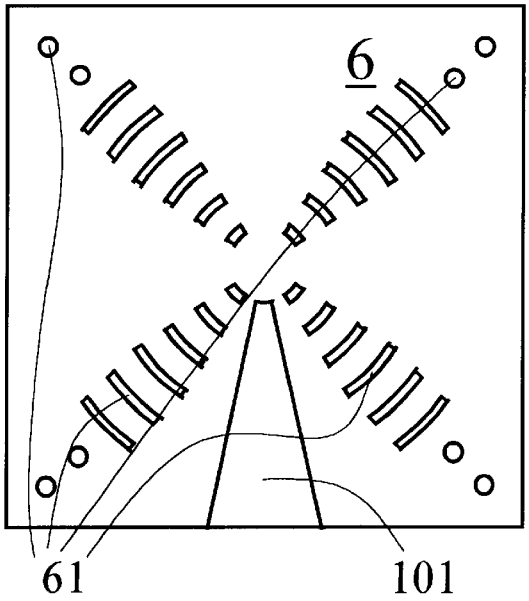

FIG. 11 is simply a schematic, top, plan view of the embodiment of FIG. 10, although for simplicity of drawing, less drive belt guides 61 are shown. FIG. 12 comprises the belt label display enhancer 101 of FIG. 11, but belt label display enhancer 101 does not comprise any of the drive belt guides 61 thereon. So in this figure, drive belt guides 61 comprise but a single set of belt guide structures. This can readily be reversed, i.e., a single set of belt guide structures can be combined with belt label display enhancer 101 such as would be realized by removing the upper set of drive belt guides 61 from FIG. 11. Also, in all embodiments, it is to be understood that belt label display enhancer 101 is an optional element, not a required element. FIG. 13 illustrates drive belt guides 61 comprising three sets of belt guide structures as shown, with an illustrated angle of approximately 120 degrees between the alignments of each of these sets, as well as belt label display enhancer 101, as shown. FIG. 14 illustrates drive belt guides 61 comprising four sets of belt guide structures with about a 90 degree alignment difference between sets, as well as belt label display enhancer 101, as shown. Note that in FIG. 14, some of the belt guide structures are ribs, and others (toward the outside corners) are pegs. The use of ribs and pegs in these illustrations is for example only, and of course any type or shape of guide belt structure for drive belt guides 61 that serves the fundamental objective of maintaining endless drive belts 1 in their stored and displayed positions within belt storage and display modules 6 is considered to be within the scope of this disclosure and its associated claims.

FIGS. 15 through 18 illustrate the placement of a plurality of drive belts 1 using the belt storage and display modules 6 and drive belt guides 61 (unlabelled in FIGS. 15 through 18) of FIGS. 11 through 14, respectively, and provide a basis for discussing the functional aspects of FIGS. 9 though 14 more fully.

First, it was noted earlier (see eqs. 3 and 8 and the associated discussion) that it my be desirable to store several belts of each width and circumference, i.e., to store duplicate belts. Belt layer divider 9, which is an optional element, assists in doing this. In particular, a bottom layer of endless drive belts 1 is placed directly in the bottom surface of belt storage and display module 6, and then a belt layer divider 9 is placed atop this bottom layer of belts. Then, a next layer of endless drive belts 1 is placed atop belt layer divider 9. If desired, a second belt layer divider 9 may then be placed upon this second layer of endless drive belts 1 and then a third layer of endless drive belts 1 stacked thereon yet again, and so on for yet additional drive belt layers. This helps keep the belt layers neatly stacked.

Next, as was noted earlier, the line drawn on the top of each drive belt guides 61 in FIGS. 9 and 10 is slightly thicker than the remaining drawing lines. This is schematically illustrative of the fact that it may be desirable to incorporate certain surface features into drive belt guides 61 which are capable of helping retain endless drive belts 1 in place even if belt storage and display module 6 is moved from a horizontal plane (such as when it is in storage within drive belt storage facility 8) to be oriented in a vertical plane (such as when it is hung onto a wall for display). These drive belt retention features include, but are not limited to, changes in thickness along given drive belt guides 61 to better retain the belts; and angling drive belt guides 61 at an angle other than 90 degrees (for example, anywhere from 30 to 90 degrees, or 60 to 90 degrees, or 80 to 90 degrees) from the bottom surface of belt storage and display module 6, so the belts are still retained if belt storage and display module 6 is displayed in an upright, vertical position, such as on a wall.

Next, we turn to belt label display enhancer 101. It is customary for a given endless drive belt 1 to be labeled with identifying information about that belt, on the outer circumferential surface of the belt. When multiple belts are stored and displayed circumferentially within one another such as shown in FIGS. 7, 8, and 15–18, it may be difficult to see the label on a given endless drive belt 1 without partially lifting the belt from its stored position. Therefore, belt label display enhancer 101, such as but not limited to the illustrated belt label display ramp, causes at least part of the circumference of each endless drive belt 1 to be partially raised with respect to the next circumferentially-larger belt surrounding it. By then ensuring that endless drive belts 1 are placed into storage such that the labels of inner belts are slightly raised with respect to those of outer belts, it becomes possible to view these labels from the belts' storage positions, without having to manually raise these belts. The illustrated belt label display ramp is but one example of how this may be achieved. For example, the entire circumference of the inner belts might be slightly raised with respect to the circumference of the next circumferentially-larger adjacent belt, which is to say that the illustrated belt label display ramp can form a full 360 degrees arc around belt storage and display module 6, thus forming a wide-angled cone with a vertex of less than the 180 degrees which of course would characterize a flat surface, for example, at least 160 degrees, or at least 170 degrees, or at least 175 degrees. Or, the arc of belt label display ramp can transcend less than 360 degrees, for example, up to 180 degrees, or up to 90 degrees, or up to 60 degrees, or up to 45 degrees, or up to 30 degrees, or up to 20 degrees, or up to 10 degrees, etc. It will be observed that the arc of the belt label display ramps illustrated in FIGS. 11–18 is approximately 25 degrees.

Figure 15:
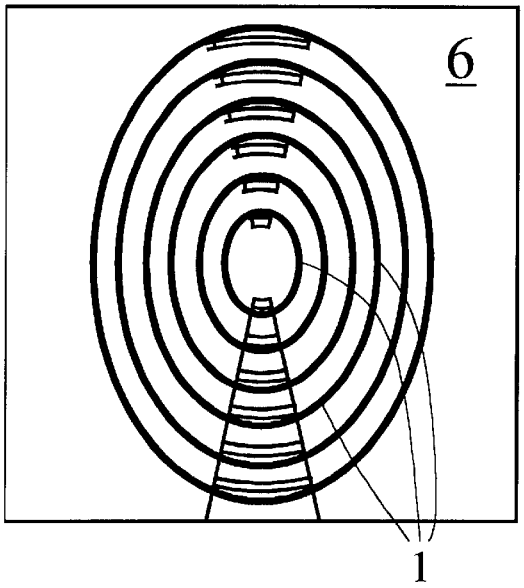
FIGS. 15–18 are schematic, top, plan views, respectively, of the embodiments of FIGS. 11–14 as used to store and display endless drive belts, to illustrate examples of different ways in which the storage and display of these drive belts can be configured.
Figure 16:
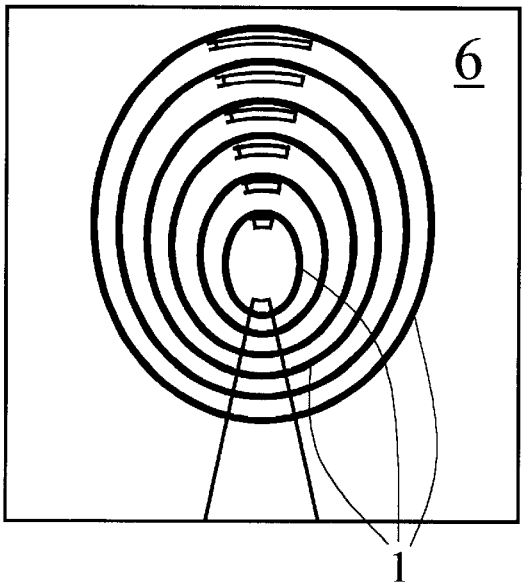
Figure 17:
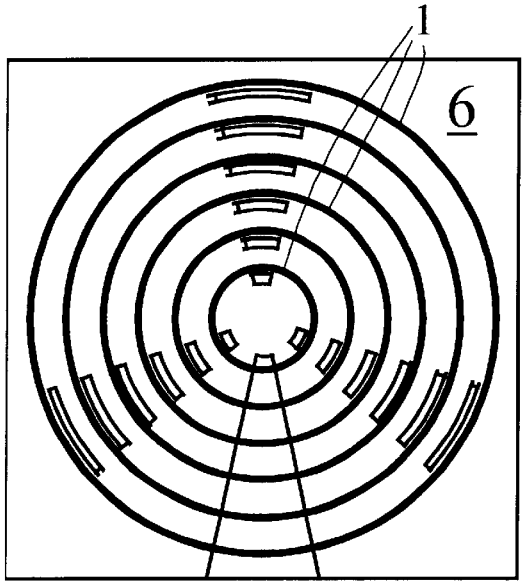
Figure 18:
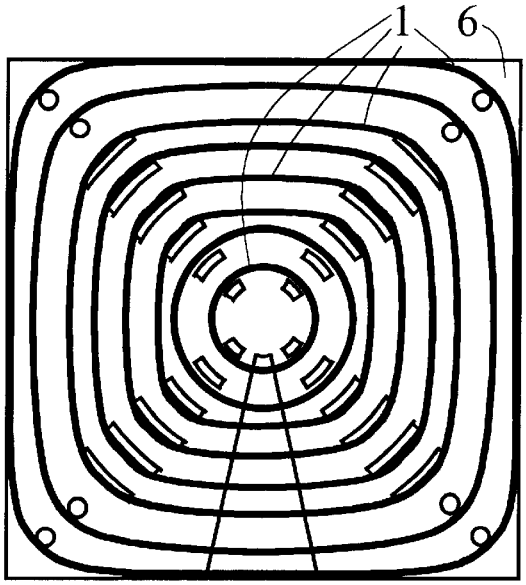

Finally, it is to be observed from FIGS. 15 through 18 that while endless drive belts 1 are circumferentially stored within one another, that there is some latitude for exactly how this storage is configured. In FIG. 17, and as earlier shown in FIGS. 7 and 8, endless drive belts 1 are circumferentially stored both concentrically, and circularly, i.e., with all regions of the circumference bent at the natural radius of curvature. In FIG. 15, the belts are circumferentially stored concentrically, but ovularly rather than circularly. Here, some belt regions (upper and lower) are therefore bent slightly in excess of the natural radius of curvature, and other belt regions (left and right) are bent at slightly less than the natural radius of curvature. In FIG. 16. the belts are circumferentially stored, but this storage is neither concentric, nor circular. In FIG. 18, the belts are circumferentially stored, and are also concentrically stored but are not circularly stored. The curvature here creates a mild squaring of at least the outer belts at their upper and lower left and right corners, as shown. This enables all of the rectangular or (as illustrated here) square region of belt storage and display module 6 to be utilized for storage, whereas in FIGS. 15–17, the four corners of belt storage and display module 6 are not used, and therefore could be viewed as wasted space.

In all cases, belts of different circumference are circumferentially stored within one another, which is to be interpreted simply as meaning that smaller-circumference belts are stored within the circumference of wider-circumference belts, with no other limitation. These belts can also be stored circularly, as in FIG. 17, but it is not required that these be stored circularly, such as in FIGS. 15, 16, and 18 which illustrate non-circular storage. These belts can also be stored concentrically, as in FIGS. 15, 17, and 18, but it is not required that these be stored concentrically, such as in FIG. 16 which illustrates non-concentric storage. In all situations where the storage is non-circular, some regions of the belt will be stored at a radius of curvature that exceeds the natural radius of curvature (defined as the degree of bend when the belt is stored circularly), and other regions will be stored at a radius of curvature that is less than the natural radius of curvature. However, in all situations, it is highly preferred that the outer circumference of a belt be convexly curved (and never concavely curved as for example in U.S. Pat. No. 4,150,745), and it is also highly preferred that the convex radius of curvature at any point preferably not exceeds the natural radius of curvature by a curvature ratio exceeding 2 to 1, or 3 to 1, or 4 to 1, or 5 to 1, or, at the outer limit, 6 to 1. Thus, the deformation that is introduced, for example, by storage methods such as in FIG. 1 is averted.

While only certain preferred features of the invention have been illustrated and described, many modifications and changes will occur to those skilled in the art. It is, therefore, to be understood that the appended claims are intended to cover all such modifications and changes as fall within the true spirit of the invention.

I claim:

1. A system for storing and displaying endless drive belts, comprising:

at least one drive belt storage and display module comprising a plurality of drive belt guides for maintaining a plurality of endless drive belts of differing circumference; and a belt label display enhancer capable of causing at least part of a circumference of at least one of said endless drive belts to be partially raised with respect to a next circumferentially-larger belt surrounding said at least one of said endless drive belts; wherein:

said drive belt guides are capable of maintaining said plurality of endless drive belts of differing circumference circumferentially within one another.

2. The system of claim 1 in combination with said plurality of endless drive belts, further comprising:

said plurality of endless drive belts, wherein:

differing-circumference drive belts among said plurality of endless drive belts are maintained circumferentially within one another by said drive belt guides.

3. The system of claim 1, wherein said drive belt guides are further capable of maintaining a plurality of endless drive belts of substantially the same circumference in a plurality of drive belt layers on top of one another.

4. The system of claim 1, further comprising a belt layer divider capable of being placed atop one of said plurality of drive belt layers, and capable of having another of said plurality of drive belt layers placed atop said belt layer divider.

5. The system of claim 1, wherein said drive belt guides are further capable of maintaining said plurality of endless drive belts such that there is no region of an outer circumference of any one of said endless drive belts that is concavely curved.

6. The system of claim 1, wherein said drive belt guides are further capable of maintaining said plurality of endless drive belts such that there is no region of an outer circumference of any one of said endless drive belts that is convexly curved at a radius of curvature that exceeds a natural radius of curvature of said belt by a curvature ratio selected from the curvature radius group consisting of 2 to 1, 3 to 1, 4 to 1, 5 to 1, and 6 to 1.

7. The system of claim 1, wherein:

said drive belt guides are further capable of maintaining said plurality of endless drive belts of differing circumference substantially circularly within one another.

8. The system of claim 1, wherein:

said drive belt guides are further capable of maintaining said plurality of endless drive belts of differing circumference substantially concentrically within one another.

9. The system of claim 1, wherein:

said drive belt guides are further capable of maintaining said plurality of endless drive belts of differing circumference substantially circularly and concentrically within one another.

10. The system of claim 1, said drive belt guides further comprising drive belt retention features capable of helping retain said endless drive belts in place.

11. The system of claim 3 in combination with said plurality of endless drive belts, further comprising:

said plurality of endless drive belts, wherein:

same-circumference drive belts among said plurality of endless drive belts are maintained in a plurality of drive belt layers on top of one another.

12. The system of claim 1, wherein, for a drive belt set comprising endless drive belts which differ from adjacently-circumferenced drive belts by a predetermined circumferential length denoted $\delta$, and which each comprise an approximate maximum thickness denoted T:

a total of at least $M=\text{int}(2\pi T/\delta)+1$ of said drive belt storage and display modules are provided to maintain and display said drive belt set, where int(x) denotes the integer part of x;

said drive belt guides within a given one of said drive belt storage and display modules are capable of maintaining adjacently-circumferenced drive belts at circumferences differing from one another by approximately $\Delta C = M \cdot \delta = \delta[\mathrm{int}(2\pi T/\delta)+1]$ and at radii differing from one another by approximately $M \cdot \delta/2\pi$; and if an approximate minimum belt circumference to be maintained for said drive belt set is denoted by $C_{min}$ and an approximate maximum belt circumference to be maintained for said drive belt set is given by $C_{max}$, then:

said drive belt guides within a first one of said M belt storage and display modules is capable of maintaining belts ranging in size from approximately $C_{smallest}=C_{min}$ to $C_{largest}=C_{min}+\Delta C \cdot x$, by circumferential increments of approximately $\Delta C$, where x is the largest integer that can be chosen such that $C_{largest} \leqq C_{max}$; and said drive belt guides within additional ones of said M belt storage and display modules, if M>1, are capable of maintaining belts ranging in size from approximately $C_{smallest}=C_{min}+z \cdot \delta$ to $C_{largest}=C_{min}+z \cdot \delta+\Delta C \cdot x$, by increments of approximately $\Delta C$, where x is the largest integer that can be chosen such that $C_{largest} \leqq C_{max}$, and where z=1, 2, 3, . . . M−1.

13. The system of claim 3, wherein said drive belt storage and display module and the drive belt guides thereof are capable of maintaining,said same-circumference endless drive belts to a storage and display depth given by $D \geqq N \times W$; wherein said plurality of endless drive belts of substantially the same circumference comprises a number denoted N of said same-circumference endless drive belts, and each of said same-circumference endless drive belts comprises a width denoted W.

14. A system for organizing, storing and displaying endless drive belts, comprising:

at least one drive belt storage and display module comprising a plurality of drive belt guides for maintaining a plurality of endless drive belts of differing circumference; wherein:

said drive belt guides are capable of maintaining said plurality of endless drive belts of differing circumference circumferentially within one another; and for a drive belt set comprising endless drive belts which differ from adjacently-circumferenced drive belts by a predetermined circumferential length denoted $\delta$, and which each comprise an approximate maximum thickness denoted T:

a total of at least $M=\mathrm{int}(2\pi T/\delta)+1$ of said drive belt storage and display modules are provided to maintain and display said drive belt set, where int(x) denotes the integer part of x;

said drive belt guides within a given one of said drive belt storage and display modules are capable of maintaining adjacently-circumferenced drive belts at circumferences differing from one another by approximately $\Delta C = M \cdot \delta = \delta[\mathrm{int}(2\pi T/\delta)+1]$ and at radii differing from one another by approximately $M \cdot \delta/2\pi$; and if an approximate minimum belt circumference to be maintained for said drive belt set is denoted by $C_{min}$ and an approximate maximum belt circumference to be maintained for said drive belt set is given by $C_{max}$, then:

said drive belt guides within a first one of said M belt storage and display modules is capable of maintaining belts ranging in size from approximately $C_{smallest}=C_{min}$ to $C_{largest}=C_{min}+\Delta C \cdot x$, by circumferential increments of approximately $\Delta C$, where x is the largest integer that can be chosen such that $C_{largest} \leqq C_{max;\ and}$ said drive belt guides within additional ones of said M belt storage and display modules, if M>1, are capable of maintaining belts ranging in size from approximately $C_{smallest}=C_{min}+z \cdot \delta$ to $C_{largest}=C_{min}+z \cdot \delta+\Delta C \cdot x$, by increments of approximately $\Delta C$, where x is the largest integer that can be chosen such that $C_{largest} \leqq C_{max}$, and where z=1, 2, 3, . . . M−1.

15. The system of claim 14, wherein said drive belt guides are further capable of maintaining a plurality of endless drive belts of substantially the same circumference in a plurality of drive belt layers on top of one another.

16. The system of claim 15, further comprising a belt layer divider capable of being placed atop one of said plurality of drive belt layers, and capable of having another of said plurality of drive belt layers placed atop said belt layer divider.

17. The system of claim 14, wherein said drive belt guides are further capable of maintaining said plurality of endless drive belts such that there is no region of an outer circumference of any one of said endless drive belts that is concavely curved.

18. The system of claim 14, wherein said drive belt guides are further capable of maintaining said plurality of endless drive belts such that there is no region of an outer circumference of any one of said endless drive belts that is convexly curved at a radius of curvature that exceeds a natural radius of curvature of said belt by a curvature ratio selected from the curvature radius group consisting of 2 to 1, 3 to 1, 4 to 1, 5 to 1, and 6 to 1.

19. The system of claim 14, wherein:

said drive belt guides are further capable of maintaining said plurality of endless drive belts of differing circumference substantially circularly within one another.

20. The system of claim 14, wherein:

said drive belt guides are further capable of maintaining said plurality of endless drive belts of differing circumference substantially concentrically within one another.

21. The system of claim 14, wherein:

said drive belt guides are further capable of maintaining said plurality of endless drive belts of differing circumference substantially circularly and concentrically within one another.

22. The system of claim 14, said drive belt guides further comprising drive belt retention features capable of helping retain said endless drive belts in place.

23. The system of claim 14, further comprising a belt label display enhancer capable of causing at least part of a circumference of at least one of said endless drive belts to be partially raised with respect to a next circumferentially-larger belt surrounding said at least one of said endless drive belts.

24. The system of claim 14 in combination with said plurality of endless drive belts, further comprising:

said plurality of endless drive belts, wherein:

differing-circumference drive belts among said plurality of endless drive belts are maintained circumferentially within one another by said drive belt guides.

25. The system of claim 15 in combination with said plurality of endless drive belts, further comprising:

said plurality of endless drive belts, wherein:

same-circumference drive belts among said plurality of endless drive belts are maintained in a plurality of drive belt layers on top of one another.

26. The system of claim 15, wherein said drive belt storage and display module and the drive belt guides thereof are capable of maintaining said same-circumference endless drive belts to a storage and display depth given by $D \geqq N \times W$; wherein said plurality of endless drive belts of substantially the same circumference comprises a number denoted N of said same-circumference endless drive belts, and each of said same-circumference endless drive belts comprises a width denoted W.

* * * * *